US007665506B2

(12) United States Patent
Coenraets

(10) Patent No.: US 7,665,506 B2
(45) Date of Patent: Feb. 23, 2010

(54) SELF-REPAIRABLE SHUTTER DEVICE

(75) Inventor: Benoit Coenraets, Brussels (BE)

(73) Assignee: Dynaco International S.A., Brussels (BE)

( * ) Notice: Subject to any disclaimer, the term of this patent is extended or adjusted under 35 U.S.C. 154(b) by 156 days.

(21) Appl. No.: 11/404,114

(22) Filed: Apr. 14, 2006

(65) Prior Publication Data

US 2006/0248819 A1 Nov. 9, 2006

(30) Foreign Application Priority Data

Apr. 15, 2005 (BE) ..... 2005/0198

(51) Int. Cl.
*E06B 9/17* (2006.01)
*E06B 9/56* (2006.01)

(52) U.S. Cl. ..... 160/266; 160/273.1; 160/271

(58) Field of Classification Search ..... 160/271, 160/273.1, 268.1, 266
See application file for complete search history.

(56) References Cited

U.S. PATENT DOCUMENTS 1,685,522 A * 9/1928 Dixson ..... 160/31
1,694,314 A * 12/1928 Dixson ..... 160/273.1
1,779,646 A * 10/1930 Traut ..... 160/271
1,786,054 A * 12/1930 Dixson ..... 160/273.1
3,116,097 A * 12/1963 Novales ..... 312/297
4,133,077 A * 1/1979 Jasniewicz et al. ..... 452/5
4,516,618 A * 5/1985 Gardner et al. ..... 160/120
4,601,320 A * 7/1986 Taylor ..... 160/271
4,651,796 A * 3/1987 Gardner et al. ..... 160/266
4,884,617 A * 12/1989 Coenraets ..... 160/271
5,107,846 A * 4/1992 Atlas ..... 600/479
5,139,074 A * 8/1992 Warner ..... 160/271
5,141,043 A * 8/1992 Kraeutler ..... 160/264
5,141,044 A * 8/1992 Hying et al. ..... 160/271
5,219,015 A * 6/1993 Kraeutler ..... 160/271
5,632,317 A * 5/1997 Krupke et al. ..... 160/265
5,992,096 A * 11/1999 De La Cerda et al. ..... 49/169
6,152,207 A * 11/2000 Varley ..... 160/264
6,722,416 B2 * 4/2004 Varley et al. ..... 160/264
6,983,786 B2 * 1/2006 Chen ..... 160/370.22

(Continued)

FOREIGN PATENT DOCUMENTS

EP 0 272 733 A1 6/1988

*Primary Examiner*—Katherine W Mitchell
*Assistant Examiner*—Jaime F Cardenas-Garcia
(74) *Attorney, Agent, or Firm*—Browdy and Neimark, PLLC

(57) ABSTRACT

The invention is relative to a roller shutter device (3) designed to close a window (1) or other opening, the shutter (3) having side edges (4) that are held in guide tracks (5) and which can be disengaged from their guide tracks (5), each of the guide tracks (5) having an access opening (6) in their upper part through which the corresponding edge (4) of the shutter (3), which may have become disengaged, can once again be engaged into the portion of the guide track considered located above this access opening (6) when the shutter (4) is being moved into its open position, control means (9, 10) being foreseen, at least up to a level located below the portion (12) of the abovementioned guide track, on either side of a plane extending in the longitudinal direction of the guide tracks (5) and passing through the latter, these means allowing the possible sway of the shutter (3) to be controlled at the point where these side edges (3) are engaged into said portion (12) of the guide track through the access opening (6).

11 Claims, 2 Drawing Sheets

U.S. PATENT DOCUMENTS 7,036,549 B2 * 5/2006 Coenraets ..... 160/271
7,131,481 B2 * 11/2006 Varley et al. ..... 160/273.1
7,231,953 B2 * 6/2007 Varley et al. ..... 160/273.1
2003/0188837 A1 10/2003 Varley et al.
2004/0182024 A1 * 9/2004 Varley et al. ..... 52/243.1
2005/0178510 A1 * 8/2005 Coenraets ..... 160/271

* cited by examiner

SELF-REPAIRABLE SHUTTER DEVICE

FIELD OF THE INVENTION

This invention is relative to a shutter device designed to close a window or other opening. The shutter has side edges that are held in guide tracks during movement of the shutter between an open position and a closed position. These side edges disengage from the guide tracks as soon as a certain traction force transversal to the longitudinal direction of the guide tracks is exerted on the shutter. Each of the guide tracks has an access opening in their upper part, whereby a portion of the guide tracks is located above this access opening, through which access opening the corresponding edge of the shutter, after being disengaged from the guide track, is again engaged the guide track when the shutter is moved into its open position.

It concerns more particularly a device of the type which forms the object of European patent EP 0272 733.

A significant problem with some of these devices is that there is a risk of damaging the side edges of the shutter, which have become disengaged from their guide track, when reintroduced through the access opening, mention of which was made in this European patent.

Furthermore, in the event these side edges are slightly compressible and feature a rolled edge, for example, it was noted that there is a possibility that they again exit the portion of the track located above the access opening after having been reintroduced.

These problems especially occur when the shutter is being opened at relatively high speeds.

As a result, one of the essential purposes of this invention is to counter these major drawbacks, independently of the shutter's opening speed, and by proposing an extremely simple solution that can be applied to all types of device of the type previously mentioned, without having to make significant constructive modifications.

BRIEF SUMMARY OF THE INVENTION

In relation thereto, the device according to the invention is characterized in that control means are provided at a level located below the portion of the guide track located above the access opening, on either side of a plane extending in the longitudinal direction of the guide tracks and passing through the latter. These control means thus allow the possible sway of the shutter to be controlled at the point where these side edges are engaged into said portion of the guide track through the access opening.

Advantageously, the control means located on the side of the window or other opening are formed by a lintel defining the top of the window or other opening.

According to a special embodiment, the control means, located on the side of the plane opposite that oriented toward the window or other opening, are formed by a bar extending substantially horizontally and parallel to the aforementioned plane.

According to another embodiment of the invention, the control means include, facing each of the guide tracks, at least one centering device located at least on the side of the above-mentioned plane opposite that oriented toward the window or other opening and extending at least partially to a level below the aforementioned portion of the guide track. The shape and location of this device ensuring the guidance of the side edge of the shutter, which may have become disengaged from one of the guide tracks, toward the entrance of the portion of the guide track located above the access opening.

Other details and characteristics of the invention will become more apparent from the following description, which is an opened-ended example of a few specific embodiments of the invention with reference to the accompanying drawings.

BRIEF DESCRIPTION OF THE SEVERAL VIEWS OF THE DRAWINGS

The various figures use the same reference numbers to refer to similar or identical elements.

DETAILED DESCRIPTION OF THE INVENTION

Generally speaking, the device according to the invention includes a shutter designed to close a window or any other opening.

Within the scope of this invention, the term "shutter" refers to all supple and/or flexible element forming a door enabling a window or other opening to be closed, such as a curtain, tarp, a set of slats, etc.

The side edges of the shutter are designed to slide in the guide tracks enabling it to move between an open position and a closed position.

In the open position, the shutter is, for example, wound around a shaft or drum or folded on to itself in the same manner as an accordion.

When, for whatever reason, a relatively strong traction force is applied on the side edges of the shutter, transversally to these edges, at the moment when the shutter is in its closed or intermediate position or when moving to its closed position, they can become disengaged from the guide tracks via a longitudinal slot in the track on the shutter side.

The upper part of the guide track features an access opening through which the shutter is automatically reinserted when it is moved toward its open position.

Given that this reinsertion system is known by European patent EP 0 272 733, it was not deemed necessary to describe it in further detail.

As already mentioned in the introduction of the description, when the shutter moves toward its open position, there is a risk that it may swav with relatively significant amplitude around an axis passing by the lower end of the portion of the guide tracks situated above the access opening owing to impact from a vehicle or the wind.

Figure 3:
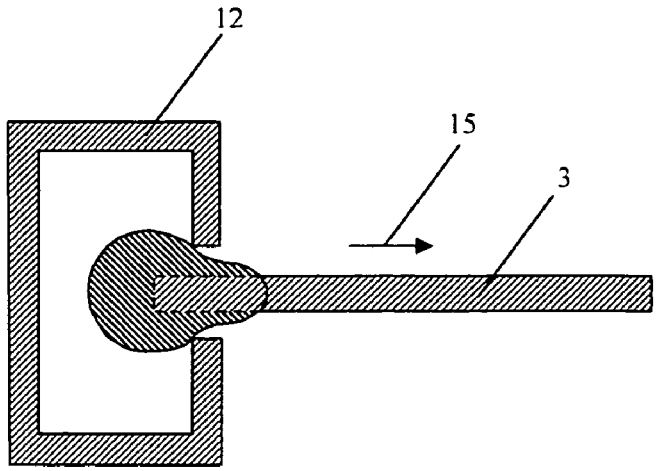
FIG. 3 schematically represents a cross-sectional view of yet another embodiment.

As a result, the side edges strike forcibly against this end and may damage themselves (see FIG. 3).

According to the invention, this major problem was solved very efficiently by providing control means which allow the side edge concerned to be directed in front of the access opening before entering it.

Owing to these control means, contact between the side edges of the shutter and the lower edge of the portion of the guide track located above the access opening is avoided or reduced to a minimum.

Figure 1:
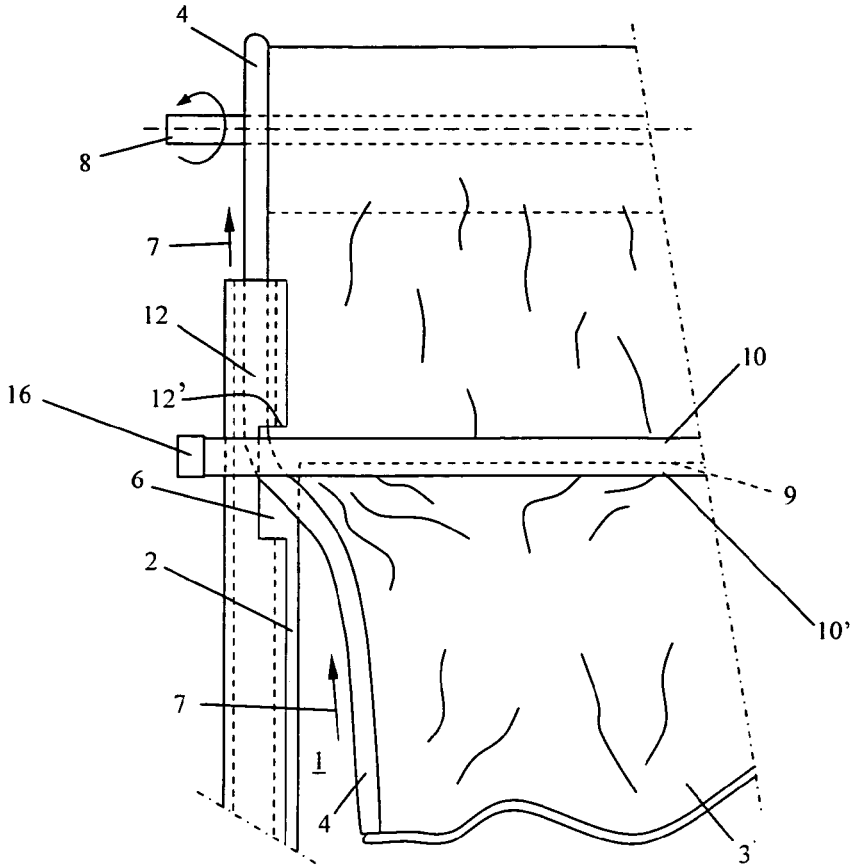
FIG. 1 is a schematic front view, with a partial break, of part of a first embodiment of the invention.
Figure 2:
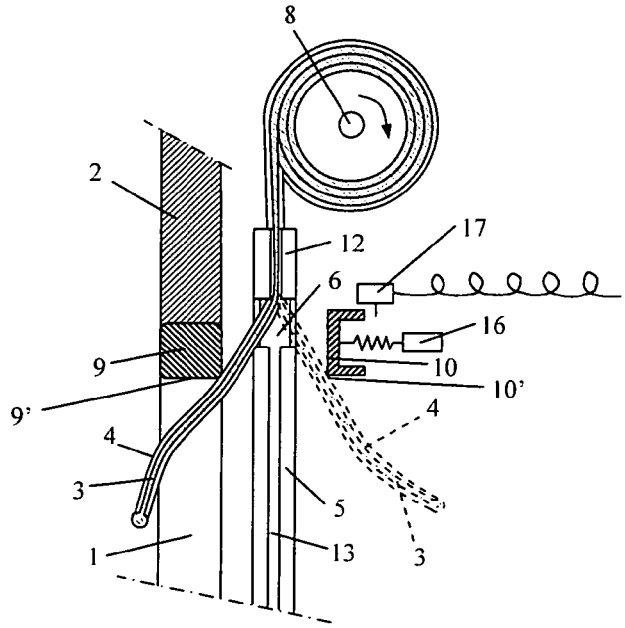
FIG. 2 represents a partial longitudinal cross-sectional view of an embodiment similar to that of FIG. 1.

FIGS. 1 and 2 schematically represent a first embodiment of a shutter device for closing a window 1 in a wall 2.

FIG. 2 is not an exact longitudinal cross section of the embodiment represented in FIG. 1, although essentially stands out from that of FIG. 1 by the relative dimensions of certain parts.

The shutter is formed by a tarp 3, the side edges 4 of which are designed to move in guide tracks 5 which define the window 1 laterally. A longitudinal slot 13 and an access opening 6 are provided in these guide tracks 5 in order to reinsert the side edges 4. The tarp 3 can be brought into an open or closed position.

In FIGS. 1 and 2, the tarp 3 is in an intermediate position and one of the side edges 4 of this tarp 3 has become disengaged from one of the guide tracks 5. The tarp is subjected to an ascending movement, as indicated by the arrow 7, in order to be wound around a shaft or drum 8 and to bring it, in this manner, into its open position.

In this embodiment, the aforementioned control means are formed by a lintel 9 defining the top of the window 1, on the one hand and by a horizontal bar 10 extending on the side of the shutter opposite that where the lintel 9 is located, on the other hand.

The lintel 9 and this bar 10 are located practically opposite one another with their lower edge 9, 10' slightly below the level of the lower edge of the portion 12 of the guide tracks 5 located above the access opening 6.

This thus allows the tarp 3 to first enter into contact with the lintel 9 and the bar 10 before the side edge 4 enters the portion 12 of the guide tracks 5.

In this manner, the swaying of the tarp at the entrance of the access opening 6 is controlled.

In this particular case, the bar 10 extends substantially over the entire length of the tarp 3 and is mounted using elastic means 16, such as springs, in relation to the guide tracks 5.

However, in order to prevent the side edge 4 from coming into contact with the bar 10, the latter advantageously extends only opposite the part of the tarp 3 located a slight distance from its side edges 4.

Furthermore, for symmetry-related reasons and for correct operation for example, the lower edge of the lintel 9 and that of the bar 10 are advantageously located not only at substantially the same level, but also at the same distance from the guide tracks 5.

For questions concerning installation and in order to obtain sufficient stiffness for example, bar 10 is made of a U-shaped structural section whose web is substantially parallel to the plane of the tarp 3.

Another embodiment, not illustrated in the figures, stands out in relation to the previous embodiment by the fact that the control means are comprised of centering devices located essentially facing the lower edge of the portion of the guide tracks located above the access opening.

These centering devices are, for example, formed by plates whose face oriented toward the access opening preferably has a convex shape in the side edge's displacement direction in order to obtain a smooth and continuous transition of the side edges toward the entrance of the portion of the guide tracks located above the access opening.

In this embodiment, the control means do not extend over the entire width of the shutter.

To facilitate the reinsertion of the side edges 4 of the shutter 3 into the guide tracks 5, the side edges preferably have substantially continuous edges, such as rolled edges or a series of small blocks that are articulated in relation to one another.

When these side edges are formed by rolled edges, they are generally slightly compressible.

Unforeseeably, owing to the presence of control means according to the invention, it was noted that the risk that such side edges exit the position of the guide tracks 5 located above the access opening is practically null.

Figure 4:
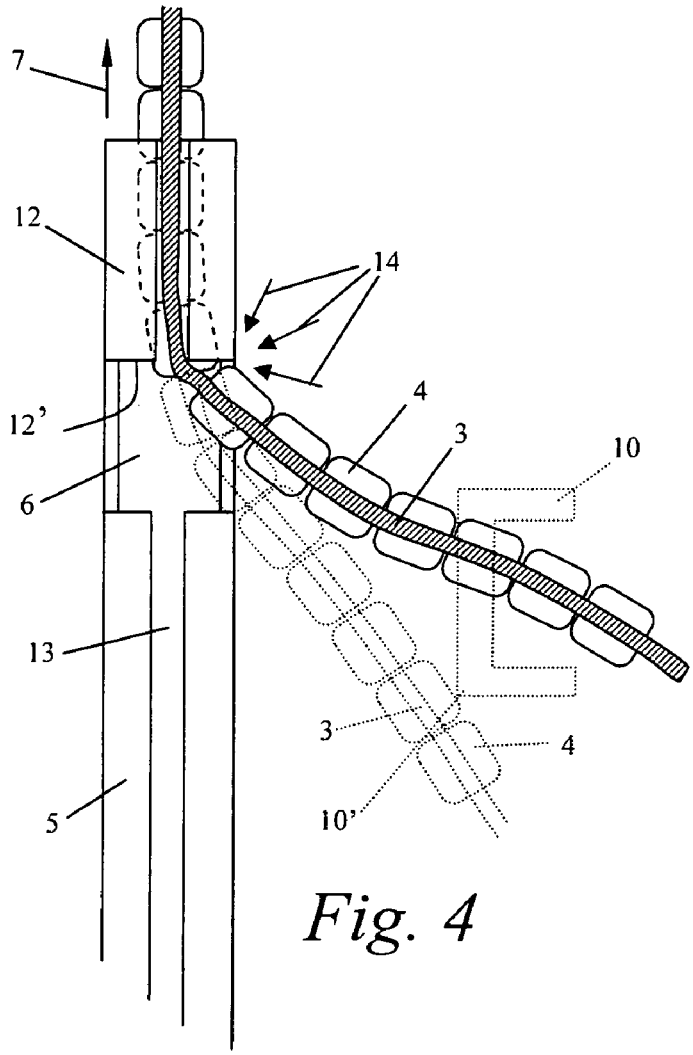
FIG. 4 is, in a larger scale, a cross-sectional view similar to that of FIG. 2 which schematically illustrates the manner in which, according to the invention, the problem of the prior art was solved.

FIG. 4 schematically represents a cross section of part of a side edge 4 formed by a slightly compressible rolled edge moving in the portion 12 of a guide track located above the access opening. This figure depicts a rolled edge 4 that is partially disengaged from this portion 6 of the guide track as a result of a transversal traction force indicated by the arrow 15 by the absence of control means, according to the invention.

Furthermore, for safety reasons, the control means can feature a detector generally known in the art, schematically shown in FIG. 2, being able to act, for example, on the shutter's drive means in order to slow it down or stop it and/or on an alarm system if the force exerted by the shutter on the control means exceeds a certain limit. This detector can, for example, cooperate with the elastic means 16 on which the bar 10 can be mounted, as shown in FIG. 1, or on the bar 10 itself.

FIG. 3, which is thus, in a larger scale, a longitudinal cross section similar to that of FIG. 2, clearly shows the effect of the control means in the device according to the invention, on the reinsertion of a side edge 4 of the shutter 3 in the portion 12 of the guide tracks located above the access opening 6. In this particular case, the side edge, which is projecting in relation to the plane of the shutter 3, is formed by a series of small blocks 4 articulated in relation to one another. Solid lines represent the edge of the shutter without control means when being introduced into the aforesaid portion 12. As can be seen, as a result of the uncontrolled swaying of the shutter 3, the blocks 4 forcibly strike against the lower edge 12' of the aforementioned portion 12, as indicated by the arrows 14. If, however, as indicated by the dashed lines, according to the invention, control means are provided by a bar 10 extending the entire width of the shutter, for example, this swaying is controlled in such a manner so as to guide and center the side edge of the shutter in front of the inlet opening in the lower edge 12' of the portion 12 before it enters the latter. In order to prevent the side edge of the shutter from coming into contact with the bar 10, its length may be shorter, such that it is located only facing the part of the shutter between its side edges.

It is understood that the invention is not limited to the embodiments described above or represented in the accompanying figures, and that other variants may be considered without deviating from the scope of the invention.

In this manner, the shape and nature of the control means may vary significantly.

The invention claimed is:

1. A roller shutter device (3) adapted and so constructed to close a window (1) or other opening, the shutter (3) having side edges (4) that are held in guide tracks (5) during a movement of the shutter (3) between an open position and a closed position, wherein the side edges (4) of the shutter (3) disengage from the guide tracks (5) when a traction force transversal to a longitudinal direction of the guide tracks (5) is exerted on the shutter (3), each of the guide tracks (5) having an access opening (6) in an upper part thereof, wherein a portion (12) of the guide tracks is located above the access opening, wherein through the access opening (6) the corresponding side edge (4) of the shutter (3), after being disengaged from the guide track (5), is again engaged into the portion (12) of the guide track located above the access opening (6) when the shutter (3) is being moved into its open position, wherein control means (9, 10) are provided, at least up to a level located below the portion (12) of the guide track located above the access opening (6), on either side of a plane extending in the longitudinal direction of the guide tracks (5) and passing through the guide tracks (5), wherein said control means are formed by a lintel (9) defining the top of the window (1) or other opening, and a bar (10), located on the side of the plane passing through the guide tracks (5) opposite said window (1) or other opening, extending substantially horizontally and parallel to said plane, and wherein said control means (9, 10) controls a sway of the shutter (3) at a point where the side edges (4) are engaged into said portion (12) of the guide track through the access opening (6).

2. The device according to claim 1, wherein said bar (10) extends at least over substantially the entire length of the shutter (3).

3. The device according to claim 1, wherein the bar (10) extends only opposite the part of the shutter (3) located between the side edges (4) of the shutter in such a manner that when the shutter sways (3), it cannot enter into contact with the side edges (4).

4. The device according to claim 1, wherein the lower edge (10') of said bar (10) extends substantially at the same height as the lower edge (9') of the lintel (9).

5. The device according to claim 1, wherein said bar (10) is formed by a structural section the core of which is substantially parallel to said plane.

6. The device according to claim 1, wherein a distance between the guide tracks (5) and said bar (10) is substantially equal to that between the lintel (9) and the guide tracks (5).

7. The device according to claim 1, wherein the control means (9, 10) include a detector enabling the shutter's movement to be slowed down or stopped and/or to trigger an alarm when the swaying of the shutter exceeds a certain predetermined amplitude.

8. The device according to claim 1, wherein the control means (9, 10) include, opposite each of the guide tracks, at least one centering device located on at least the side of said plane opposite that oriented toward the window or other opening and extending at least partially to a level below this portion (12) of said guide track (5) so as to direct the side edge (4) of the shutter (3), after being disengaged from one of the guide tracks (5), toward the portion (12) of the guide tracks located above said access opening (6).

9. The device according to claim 1, wherein the side edges of the shutter (3) are substantially continuous.

10. The device according to claim 1, wherein the bar (10) is mounted in an elastic manner in relation to the guide tracks (5).

11. The device according to claim 1, wherein a detector (17) is provided enabling the shutter to be slowed down or stopped and/or to trigger an alarm system when the force exerted by the shutter on the control means (9, 10) exceeds a certain limit.

* * * * *